US011136841B2

(12) United States Patent
Santos et al.

(10) Patent No.: US 11,136,841 B2
(45) Date of Patent: Oct. 5, 2021

(54) HIERARCHICAL PRESSURE MANAGEMENT FOR MANAGED PRESSURE DRILLING OPERATIONS

(71) Applicant: SafeKick Americas LLC, Katy, TX (US)

(72) Inventors: Helio Mauricio Ribeiro dos Santos, Reading (GB); Thomas Luca Barbato, Houston, TX (US)

(73) Assignee: SAFEKICK AMERICAS LLC, Katy, TX (US)

( * ) Notice: Subject to any disclaimer, the term of this patent is extended or adjusted under 35 U.S.C. 154(b) by 29 days.

(21) Appl. No.: 16/810,609

(22) Filed: Mar. 5, 2020

(65) Prior Publication Data

US 2021/0010338 A1 Jan. 14, 2021

Related U.S. Application Data

(60) Provisional application No. 62/872,572, filed on Jul. 10, 2019.

(51) Int. Cl.
*E21B 21/08* (2006.01)
*E21B 47/06* (2012.01)
*E21B 21/10* (2006.01)

(52) U.S. Cl.
CPC ..... *E21B 21/08* (2013.01); *E21B 21/106* (2013.01); *E21B 47/06* (2013.01)

(58) Field of Classification Search
CPC ..... E21B 21/08; E21B 47/06; E21B 21/10; E21B 21/106
See application file for complete search history.

(56) References Cited

U.S. PATENT DOCUMENTS 10,323,474 B2 * 6/2019 Olsen ..... E21B 34/04
2007/0246263 A1 * 10/2007 Reitsma ..... E21B 21/08 175/38
2015/0068758 A1 * 3/2015 Leuchtenberg ..... E21B 21/001 166/336

(Continued)

OTHER PUBLICATIONS

PCT International Search Report for PCT International Application PCT/US2020/024154, dated Jun. 22, 2020.

(Continued)

*Primary Examiner* — Brad Harcourt
(74) *Attorney, Agent, or Firm* — Basil M. Angelo; Angelo IP

(57) ABSTRACT

A method of hierarchical pressure management for managed pressure drilling operations includes receiving a measured pressure value. If the measured pressure exceeds an MPD pressure set point, commanding one or more choke valves of an MPD choke manifold to open until the measured pressure is approximately equal to the MPD pressure set point or is commanded to a fully opened choke aperture setting. If at any time the measured pressure exceeds a pressure control valve set point, parking the MPD choke manifold and commanding one or more pressure control valve system valves to open until the measured pressure is less than the pressure control valve set point or is commanded to a fully opened pressure control valve setting. If at any time the measured pressure exceeds a pressure relief valve set point, commanding a pressure relief valve to open.

65 Claims, 6 Drawing Sheets

(56) References Cited

U.S. PATENT DOCUMENTS

| | | | | |
|---|---|---|---|---|
| 2016/0298401 | A1* | 10/2016 | Cotten | E21B 21/08 |
| 2016/0376859 | A1* | 12/2016 | Mehrabian | E21B 21/106<br>175/25 |
| 2018/0245411 | A1* | 8/2018 | Piccolo | E21B 21/001 |

OTHER PUBLICATIONS

PCT Written Opinion of the International Search Authority (USPTO) for PCT International Application PCT/US2020/024154, dated Jun. 22, 2020.

* cited by examiner

HIERARCHICAL PRESSURE MANAGEMENT FOR MANAGED PRESSURE DRILLING OPERATIONS

CROSS-REFERENCE TO RELATED APPLICATIONS

This application claims the benefit of, or priority to, U.S. Provisional Patent Application Ser. No. 62/872,572, filed on Jul. 10, 2019, which is hereby incorporated by reference in its entirety.

BACKGROUND OF THE INVENTION

A closed-loop hydraulic drilling system may be used to perform a variety of Managed Pressure Drilling ("MPD") techniques that seek to manage wellbore pressure during drilling and other operations through the controlled application of surface backpressure. Typically, an annular sealing system is used to controllably seal the annulus surrounding the drillstring and surface backpressure is controllably applied by manipulating the choke aperture setting, sometimes referred to as choke position, of one or more choke valves of an MPD choke manifold disposed on the surface that are fluidly connected to one or more flow lines that divert returning fluids from or below the annular seal to the surface. Each choke valve is typically capable of a fully opened state where flow is unimpeded, a fully closed state where flow is stopped, and a number of intermediate states where flow is restricted.

During conventional drilling operations, one or more MPD techniques may be used to manage wellbore pressure within a safe pressure gradient bounded by the pore pressure, or collapse pressure if the collapse pressure is higher than the pore pressure, and the fracture pressure to maintain well control. By maintaining well control, the unintended influx of formation fluids into the wellbore is prevented and the integrity of the formation is maintained preventing hydraulic fracturing. If the pressure in the annulus falls below a lower threshold, one or more choke valves of the MPD choke manifold may be closed to the extent necessary to increase the annular pressure the requisite amount. Similarly, if the pressure in the annulus increases above an upper threshold, one or more choke valves of the MPD choke manifold may be opened to the extent necessary to decrease the annular pressure the requisite amount. MPD techniques have been adopted for use in a variety of drilling and other applications and contingency response techniques.

BRIEF SUMMARY OF THE INVENTION

According to one aspect of one or more embodiments of the present invention, a method of hierarchical pressure management for managed pressure drilling operations includes receiving a measured pressure value. If the measured pressure exceeds an MPD pressure set point, one or more choke valves of an MPD choke manifold are commanded to open until the measured pressure is approximately equal to the MPD pressure set point or is commanded to a fully opened choke aperture setting. If at any time the measured pressure exceeds a pressure control valve set point, the MPD choke manifold is parked and one or more pressure control valve system valves are commanded to open until the measured pressure is less than the pressure control valve set point or is commanded to a fully opened pressure control valve setting. If at any time the measured pressure exceeds a pressure relief valve set point, a pressure relief valve is commanded to open.

According to one aspect of one or more embodiments of the present invention, a non-transitory computer readable medium comprising software instructions that, when executed by a processor, perform method of hierarchical pressure management for managed pressure drilling operations includes receiving a measured pressure value. If the measured pressure exceeds an MPD pressure set point, one or more choke valves of an MPD choke manifold are commanded to open until the measured pressure is approximately equal to the MPD pressure set point or is commanded to a fully opened choke aperture setting. If at any time the measured pressure exceeds a pressure control valve set point, the MPD choke manifold is parked and one or more pressure control valve system valves are commanded to open until the measured pressure is less than the pressure control valve set point or is commanded to a fully opened pressure control valve setting. If at any time the measured pressure exceeds a pressure relief valve set point, a pressure relief valve is commanded to open.

According to one aspect of one or more embodiments of the present invention, a system for hierarchical pressure management for managed pressure drilling operations includes an annular sealing system that provides an annular seal surrounding a drillstring, a pressure sensor that measures pressure, and an MPD choke manifold that includes a plurality of choke valves with at least one choke valve in fluid communication with a flow line that diverts returning fluids from or below the annular seal to apply surface backpressure. The system further includes an MPD control system that commands one or more choke valves of the MPD choke manifold to an MPD pressure set point, a plurality of pressure control valve system valves with at least one pressure control valve in fluid communication with the flow line that discharges returning fluids to a mud-gas-separator, shale shaker, or other fluids processing system, and a pressure control valve control system that commands one or more pressure control valve system valves to open when the measured pressure exceeds a pressure control valve set point. The system further includes a pressure relief valve that discharges returning fluids to the mud-gas separator, shale shaker, or overboard and a pressure relief valve control system that commands the pressure relief valve to open when the measured pressure exceeds a pressure relief valve set point.

Other aspects of the present invention will be apparent from the following description and claims.

DETAILED DESCRIPTION OF THE INVENTION

Figure 1:
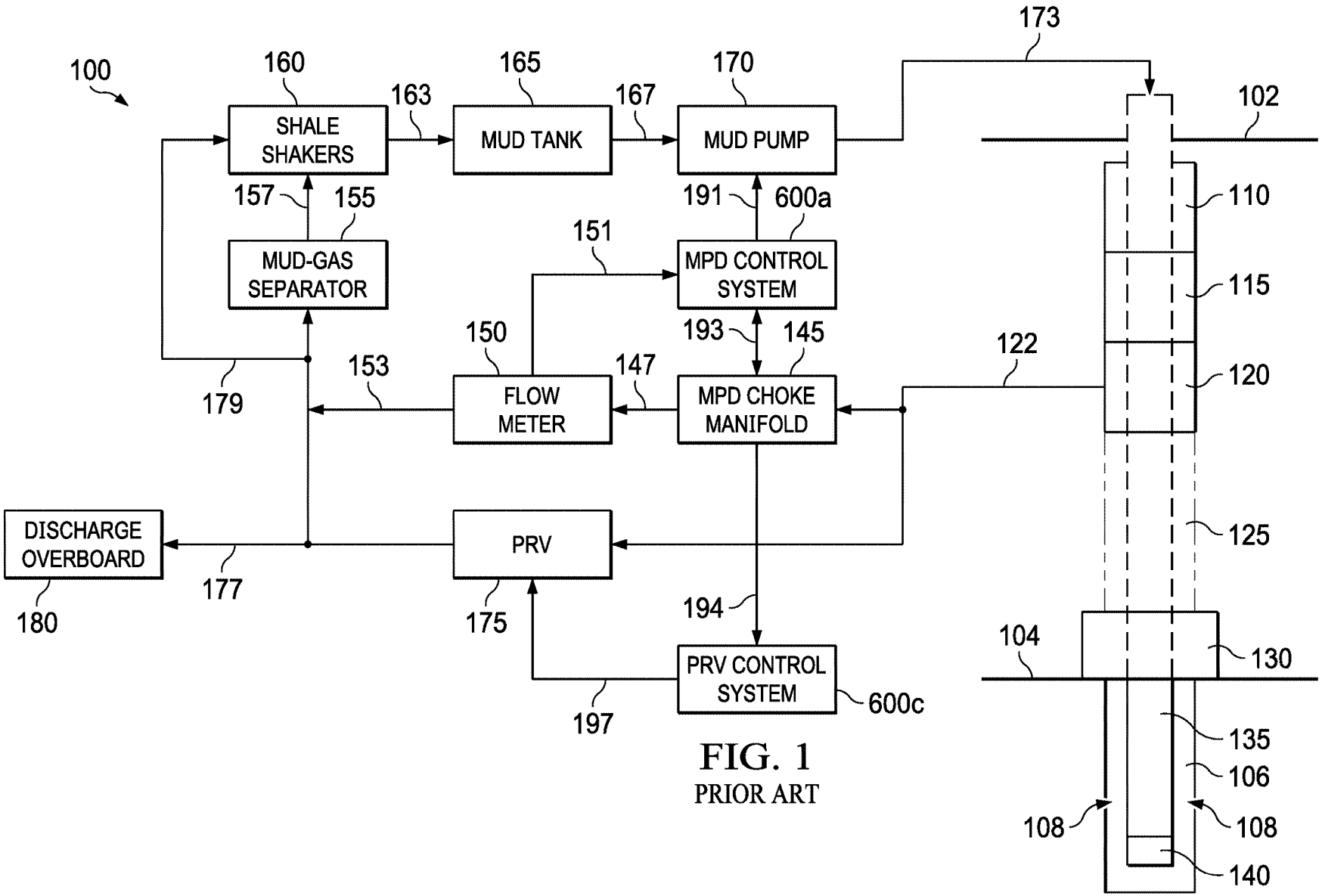
FIG. 1 PRIOR ART
FIG. 1 shows a conventional closed-loop hydraulic drilling system for managed pressure drilling operations.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

In challenging environments, including operations in deepwater and ultra-deepwater, the ability to control wellbore pressure and respond to unexpected contingencies is critically important to the safety of operations as well as protection of the environment. As such, standard industry practice seeks to maintain well control during drilling and other operations. Pragmatically, well control refers to the ability of the drilling rig to manage the potentially dangerous effects of the unintended influx of unknown formation fluids, sometimes referred to as a kick, into the well system. The unknown formation fluids may contain explosive gases that pose a significant safety risk and could potentially result in a blowout. In addition, well control also prevents fracturing the formation, thereby protecting the structural integrity of the wellbore. One way in which well control is maintained during conventional MPD operations is to maintain wellbore pressure within the safe pressure gradient bounded by the pore pressure, or collapse pressure if it is higher than the pore pressure, and the fracture pressure of the formation. However, as operators and drillers pursue more and more challenging well plans, the ability to maintain well control requires the careful navigation of a narrow safe pressure gradient, with very little room for error, that varies with depth.

In such complicated endeavors, contingencies inevitably arise, and the rig must be able to promptly and adequately respond to restore well control. Conventional methods of responding to such contingencies include, for example, shutting down the blowout preventer ("BOP"), injecting a kill mud weight, and circulating out the unknown formation fluids. As such, conventional methods of contingency response stop drilling operations, pose significant risk to the safety of on-rig personnel, and expose the environment to fouling. A significant shortcoming of standard industry practice is that they are responsive in nature, where drastic actions are only taken after contingencies have already occurred, jeopardizing the safety of rig personnel, and potentially exposing the environment to fouling. As such, there is a long felt, but unsolved need in the industry to enhance the ability to prevent such contingencies from occurring in the first place.

Accordingly, in one or more embodiments of the present invention, a method and system for hierarchical pressure management for MPD operations uses an intelligent and programmable pressure control valve ("PCV") system, including a PCV control system and one or more PCV system valves, to enhance the ability of the rig to maintain wellbore pressure within the safe pressure gradient and reduce or eliminate the number of situations in which a pressure relief valve ("PRV") is used for responding to contingencies that, despite use of the PRV, often result in the wellbore pressure exceeding the fracture pressure or falling below the pore pressure. During conventional MPD operations, the MPD choke manifold may be used to apply surface backpressure and manage wellbore pressure. The independent PCV control system may be programmed to open one or more PCV system valves when wellbore pressure exceeds a PCV set point. The PCV set point may be set at a pressure value that is less than the PRV set point, or trigger, by a sufficient margin to allow the PCV system to fully open the PCV system valves before engaging the PRV. When wellbore pressure exceeds the PCV set point, one or more of the PCV system valves may be opened and flow to a mud-gas separator ("MGS"), shale shaker, or other fluids processing system to prevent further increase in wellbore pressure while, at the same time, preventing pressure within the wellbore from falling as would typically happen if the PRV was opened. The PCV system may include an aggressive trim and control that allows it to respond very quickly and efficiently. When the PCV system is activated, the MPD choke manifold may be parked and maintain its last position. If the pressure stabilizes at or near the PCV set point, the rig crew may then investigate the root cause of the high pressure and attempt to resolve the issue while wellbore pressure is safely managed. Once the pressure issue is resolved, flow may be resumed to the MPD choke manifold and the pressure will continue to decrease to at or near the MPD pressure set point. As the pressure decreases, the PCV system will continue to close its one or more valves until it reaches a fully closed state when the pressure drops below the PCV set point, at which point normal operations may be resumed with flow only through the MPD choke manifold. If the MPD choke manifold, augmented by the PCV system, is not able to maintain wellbore pressure, the PRV may be used as the safeguard of last resort. Advantageously, the method and system for hierarchical pressure management for MPD operations protects the integrity of the wellbore without requiring the closing of the BOP or other drastic actions, whereas conventional use of a PRV alone merely seeks to protect equipment from pressure-related damage, does not protect the wellbore from fracturing, and once the PRV is engaged, typically requires shutting down on the BOP or other drastic actions to be taken.

FIG. 1 shows a conventional closed-loop hydraulic drilling system 100 for MPD operations. For the purposes of illustration only, a conventional closed-loop hydraulic drilling system 100 configured for offshore drilling operations is shown. While offshore applications require additional components such as, for example, a marine riser, to facilitate drilling a subsea wellbore, one of ordinary skill in the art will recognize that onshore applications are substantially similar in configuration and function with respect to those components necessary for MPD operations. Conventional closed-loop hydraulic drilling system 100 typically includes a conventional MPD system (e.g., annular sealing system 110, annular closing system 115, and flow diverter 120), a lower portion of a marine riser system 125, and a BOP 130. One of ordinary skill in the art will recognize that drilling system 100 may include other components such as, for example, a diverter of last resort (not shown), a ball joint (not shown), and a telescopic joint (not shown) that are typically disposed above the conventional MPD system, that are not shown.

The conventional MPD system typically includes an annular sealing system 110, an annular closing system 115 disposed below annular sealing system 110, and a flow diverter 120 disposed below annular closing system 115. Annular sealing system 110 controllably seals an annulus 108 surrounding drillstring 135 such that it is encapsulated. Annular sealing system 110 may be a Rotating Control Device ("RCD"), an Active Control Device ("ACD"), or any other type or kind of system capable of creating an annular seal such that wellbore pressure may be controlled by application of surface backpressure. Annular closing system 115 may be a redundant system for maintaining the annular seal during connections or when annular closing system 110, or components thereof, are being installed, serviced, or replaced. Flow diverter 120 diverts returning fluids from or below the annular seal to MPD choke manifold 145 that directs the returning fluids to the fluids processing systems (e.g., MGS 155 or shale shakers 160) for recycling and reuse. Flow diverter 120 is disposed above, and in fluid communication with, the lower portion of marine riser system 125. The lower portion of marine riser system 125 is disposed above, and in fluid communication with, BOP 130 disposed on or near seafloor 104. BOP 130 is disposed above, and in fluid communication with, a wellhead (not independently shown) that is disposed above, and in fluid communication with, a wellbore 106 that is being drilled. A central lumen extends through the conventional MPD system (e.g., annular sealing system 110, annular closing system 115, and flow diverter 120), lower portion of marine riser system 125, BOP 130, wellhead (not independently shown), and into wellbore 106 to facilitate drilling and other operations. Drillstring 135 may be disposed through the central lumen and include, on a distal end, a drill bit 140 used to drill wellbore 106.

During MPD operations, one or more mud pumps 170 controllably pump drilling fluids (not shown) from mud tank 165 downhole through an interior passageway of drillstring 135. The returning fluids (not shown) return through annulus 108 surrounding drillstring 135 and are controllably diverted by flow diverter 120 via flow line 122 to one or more choke valves (not independently illustrated) of MPD choke manifold 145. The one or more choke valves of MPD choke manifold 145 controllably flow via flow line 147 to flow meter 150 and flow meter 150 flows via flow line 153 to one or more fluids processing systems including, for example, MGS 155 and/or shale shakers 160 for processing prior to returning the processed fluids (not shown) to mud tanks 165 for reuse. One or more pressure sensors (not shown) are disposed in the fluid path at different locations to measure pressure of the returning fluids (not shown).

An MPD control system 600*a* may receive pressure sensor data (not shown) and flow meter 150 data in approximate or near real-time. One of ordinary skill in the art will recognize that approximate or near real-time means very nearly when measured, delayed by measurement, calculation, and/or transmission only, but typically on the order of magnitude of fractions of a second or mere seconds. MPD control system 600*a* may command one or more choke valves (not independently illustrated) of MPD choke manifold 145 to a desired choke aperture setting and/or command the flow rate of mud pumps 170, thereby controlling wellbore pressure. The pressure tight seal on the annulus provided by annular sealing system 110 allows for the precise control of wellbore pressure by manipulation of the choke aperture of one or more choke valves (not independently illustrated) of MPD choke manifold 145 and the corresponding application of surface backpressure. The choke aperture, sometimes referred to as the choke position, of one or more choke valves (not independently illustrated) of MPD choke manifold 145 corresponds to an amount, typically represented as a percentage, that choke valves (not independently illustrated), or MPD choke manifold 145 itself, is open and capable of flowing.

For example, one or more choke valves (not independently illustrated) of the MPD choke manifold 145 may be fully opened where flow is unimpeded, fully closed where flow is stopped, or partially opened or closed where flow is restricted in accordance with the degree to which it is opened or closed. If the choke operator wishes to increase wellbore pressure, the choke aperture setting of one or more choke valves (not independently illustrated) of MPD choke manifold 145 may be reduced to further restrict fluid flow and apply additional surface backpressure. Similarly, if the choke operator wishes to decrease wellbore pressure, the choke aperture setting of one or more choke valves (not independently illustrated) of MPD choke manifold 145 may be increased to increase fluid flow and reduce the amount of applied surface backpressure. As such, surface backpressure MPD systems typically manage wellbore pressure by manipulating the choke aperture setting of one or more choke valves (not independently illustrated) of MPD choke manifold 145 and/or the flow rate of mud pumps 170 that are injecting fluids downhole, based at least on pressure sensor data.

A PRV control system 600*c* controls a PRV 175 and serves as a separate and independent failsafe to protect rig equipment from damage due to high and typically uncontrollably rising pressures within system 100. PRV control system 600*c* may receive or generate pressure sensor data or other data in approximate or near real-time. PRV control system 600*c* typically stores a PRV set point that establishes the pressure at which PRV 175 is triggered and opens. Typically, the PRV set point is selected as a pressure value that protects the weakest link in the drilling system 100 from pressure damage, often the marine riser system 125 in offshore applications. Once opened, PRV 175 may discharge returning fluids from annulus 108 to the fluids processing system (e.g., MGS 155 or shall shakers 160) or overboard 180 in offshore applications. While PRV 175 is protective of rig equipment and is designed to release as much pressure as possible as quickly as possible, it does not maintain wellbore pressure, which potentially damages the structural integrity of the wellbore and the ability of the rig to conduct further MPD operations. Thus, the invocation of PRV 175 as a failsafe of last resort results in the cessation of drilling operations and typically requires drastic actions to be taken including, for example, closing BOP 130 to secure the well, thereby substantially increasing costs and compromising the ability to restore well control and resume drilling operations.

Figure 2A:
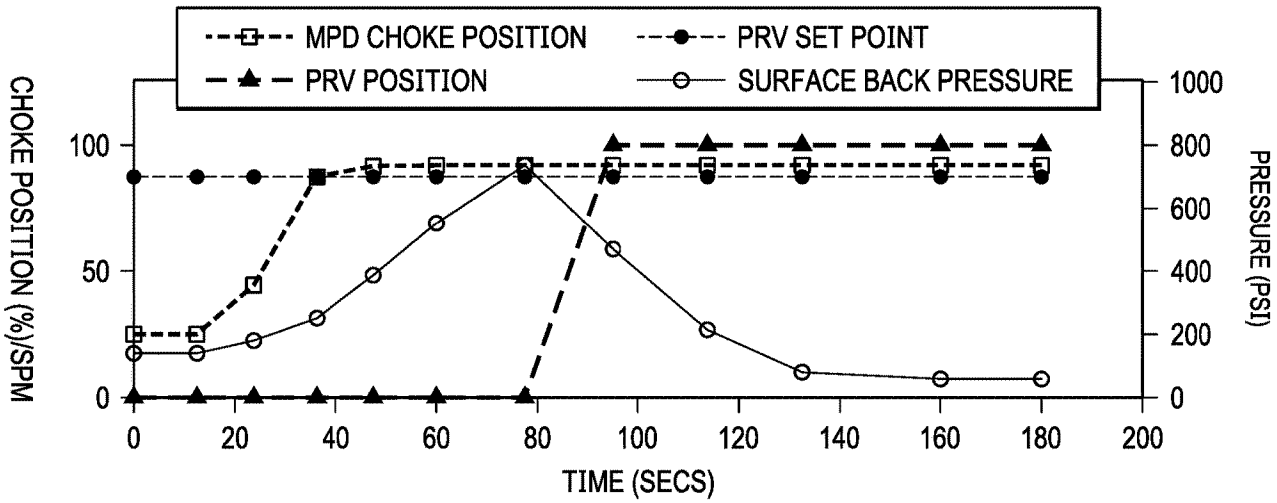
FIG. 2A shows an exemplary plot of MPD choke position, surface backpressure, pressure relief valve set point, and pressure relief valve position where the MPD choke manifold plugs, fails, or other contingency arises, surface backpressure rises, and the pressure relief valve is activated as the failsafe device in a conventional closed-loop hydraulic drilling system.

FIG. 2A shows an exemplary plot of MPD choke position, surface backpressure, PRV set point, and PRV position where the MPD choke manifold (e.g., 145 of FIG. 1) plugs, fails, or other contingency arises, surface backpressure rises, and the PRV (e.g., 175 of FIG. 1) is activated as the failsafe device of last resort in a conventional closed-loop hydraulic drilling system (e.g., 100 of FIG. 1). Initially, the MPD choke position, and corresponding surface backpressure, are relatively constant as would be expected during normal drilling operations. In the event one or more choke valves of the MPD choke manifold (e.g., 145 of FIG. 1) start to plug, fail, or other contingency arises, the surface backpressure may start to rise for reasons unrelated to the deliberate closing of one or more choke valves of the MPD choke manifold (e.g., 145 of FIG. 1). An MPD control system (e.g., 600*a* of FIG. 1) may, in response to rising surface backpressure, command one or more choke valves of the MPD choke manifold (e.g., 145 of FIG. 1) to open in an attempt to stabilize pressure. However, even after one or more choke valves of the MPD choke manifold (e.g., 145 of FIG. 1) are commanded to the fully opened choke aperture setting, surface backpressure continues to rise as shown in the example depicted. Once surface backpressure exceeds the PRV set point, the PRV control system (e.g., 600*c* of FIG. 1) is triggered and commands the PRV (e.g., 175 of FIG. 1) to activate as the failsafe of last resort to quickly release all pressure in the system (e.g., 100 of FIG. 1), including the wellbore, without concern for the impact to the structural integrity of the wellbore.

Figure 2B:
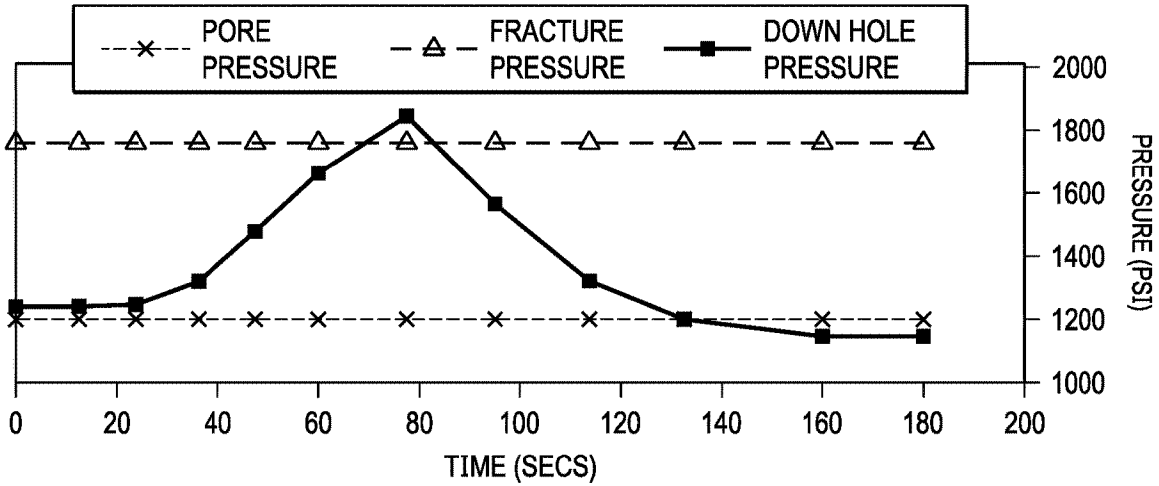
FIG. 2B shows an exemplary plot of pore pressure, fracture pressure, and downhole pressure where the MPD choke manifold plugs, fails, or other contingency arises, downhole pressure rises, and the pressure relief valve is activated as the failsafe device in the conventional closed-loop hydraulic drilling system.

Continuing, FIG. 2B shows an exemplary plot of pore pressure, fracture pressure, and downhole pressure where the MPD choke manifold (e.g., 145 of FIG. 1) plugs, fails, or other contingency arises, as described in the previous example of FIG. 2A, downhole pressure rises, and the PRV (e.g., 175 of FIG. 1) is activated as the failsafe of last resort in the conventional closed-loop hydraulic drilling system (e.g., 100 of FIG. 1). FIG. 2B shares a common time axis with that of FIG. 2A. In the example depicted, a safe pressure gradient may be established by the pore pressure and the fracture pressure as shown. Initially, the downhole pressure closely tracks, but is slightly higher than, the pore pressure, but well within the safe pressure gradient. As one or more choke valves of the MPD choke manifold (e.g., 145 of FIG. 1) start to plug, fail, or other contingency arises, the downhole pressure starts increasing. As shown in FIG. 2A, the MPD control system (e.g., 600*a* of FIG. 1) attempted to maintain the downhole pressure within the safe pressure gradient by opening up one or more choke valves of the MPD choke manifold (e.g., 145 of FIG. 1). However, the MPD choke manifold (e.g., 145 of FIG. 1) was unable to maintain downhole pressure within the safe pressure gradient and once surface backpressure exceeded the PRV set point, the PRV (e.g., 175 of FIG. 1) was activated as the failsafe of last resort to protect rig equipment from high pressure damage. While the PRV (e.g., 175 of FIG. 1) was successful in quickly relieving pressure in the system, it fails to manage wellbore. Returning to FIG. 2B, as shown in the example, downhole pressure exceeded the fracture pressure for a period of time before the PRV (e.g., 175 of FIG. 1) was able to reduce pressure and similarly, on the other side of the safe pressure gradient, downhole pressure fell below that of the pore pressure for a period of time, all of which is not surprising since the PRV (e.g., 175 of FIG. 1) merely relieves pressure within the system (e.g., 100 of FIG. 1) to prevent high pressure damage. As a consequence, the wellbore may be fractured, will likely require closing in on the BOP (e.g., 130 of FIG. 1), and other drastic actions must be taken before drilling operations can be resumed, if they can be resumed at all.

Figure 3:
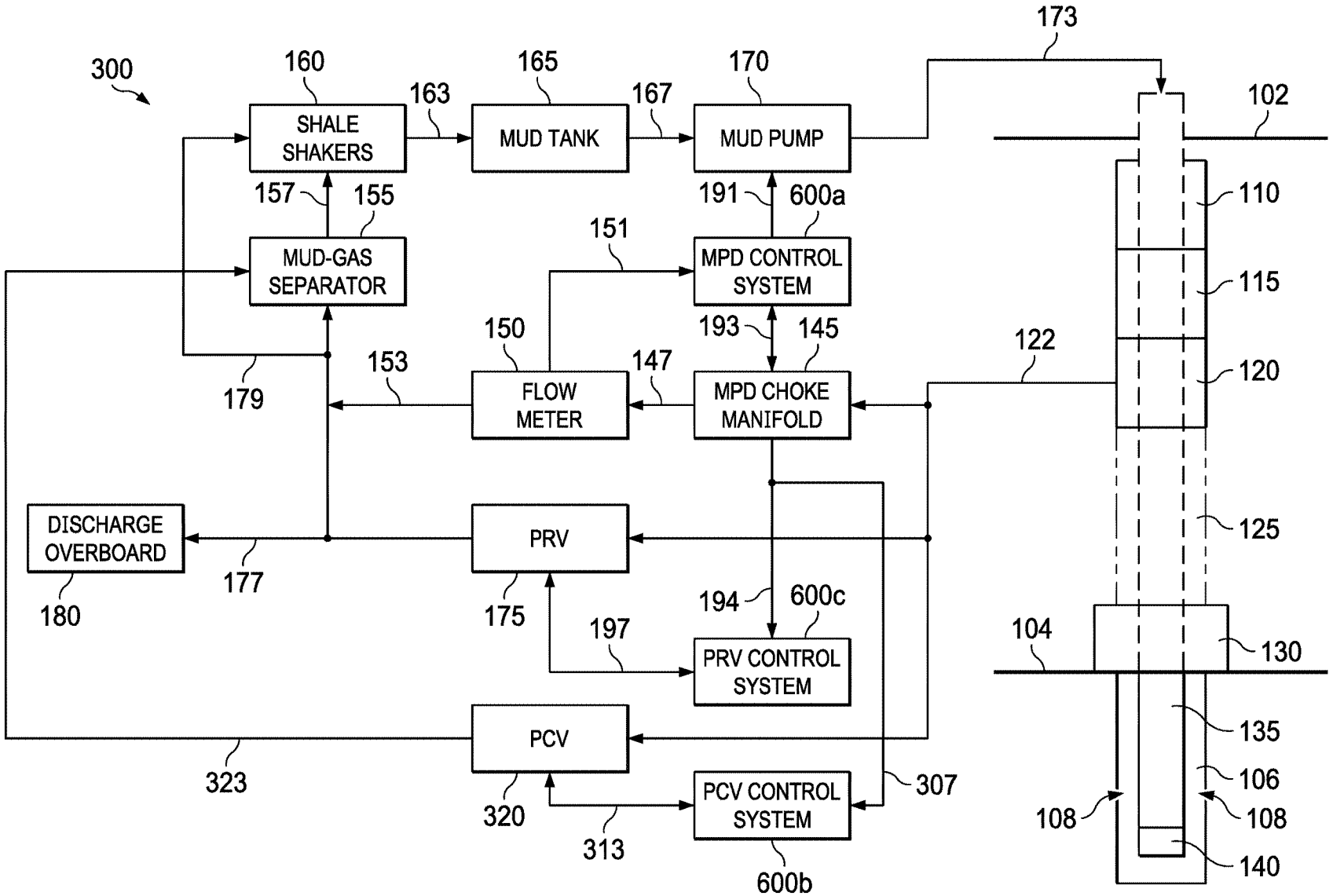
FIG. 3 shows a system for hierarchical pressure management for managed pressure drilling operations in accordance with one or more embodiments of the present invention.

FIG. 3 shows an improved closed-loop hydraulic drilling system 300 for hierarchical pressure management for MPD operations in accordance with one or more embodiments of the present invention. For the purpose of illustration only, an embodiment of a drilling system 300 for offshore drilling operations is shown and described herein. While offshore applications differ from onshore applications in that they require additional equipment to facilitate the drilling of a subsea wellbore, one of ordinary skill in the art will recognize that onshore applications are a subset that are substantially similar with respect to the configuration and function of components necessary for MPD operations. As such, one or more embodiments of the present invention contemplate application and use in both onshore and offshore applications. One of ordinary skill in the art will also recognize that the components and configuration of components of drilling system 300 may vary based on an application or design in accordance with one or more embodiments of the present invention and are not limited by the exemplary system 300 described herein.

In one or more embodiments of the present invention, one or more components of a conventional MPD system may be used to perform MPD operations. An annular sealing system 110, or the functional equivalent thereof, may be used to controllably seal annulus 108 surrounding drillstring 135 such that it is encapsulated and not atmospheric. Annular sealing system 110 may be an RCD, ACD, or any other type or kind of system capable of creating an annular seal such that wellbore pressure may be controlled by application of surface backpressure. In certain embodiments, annular closing system 115, or the functional equivalent thereof, may be disposed below annular sealing system 110 as a redundant system for maintaining the annular seal during connections or when annular closing system 110, or components thereof, are being installed, serviced, or replaced. However, annular closing system 115 may not be included in onshore or low specification systems 300. Flow diverter 120, or the functional equivalent thereof, may be disposed below annular closing system 115, or at least below the annular seal in embodiments that do not include an annular closing system 115, and divert returning fluids from or below the annular seal to MPD choke manifold 145 that controllably diverts returning fluids to the fluids processing systems (e.g., MGS 155 or shale shakers 160) for recycling and reuse. One of ordinary skill in the art will recognize that annular sealing system 110, annular closing system 115, and flow diverter 120, or the functions and features that they implement, may be included, excluded, integrated, or distributed among one or more components or riser joints based on an application or design in accordance with one or more embodiments of the present invention. For example, for purposes of illustration only, in certain onshore or low specification applications, an RCD 110 may integrate a flow diverter 120 in a drilling system 300 that does not include an annular closing system 115.

In offshore applications, flow diverter 120 may be disposed above, and in fluid communication with, a lower portion of marine riser system 125 and the lower portion of marine riser system 125 may be disposed above, and in fluid communication with, BOP 130 disposed on or near the seafloor 104. In onshore applications, flow diverter 120 may be disposed above, and in fluid communication with, BOP 130. BOP 130 may be disposed above, and in fluid communication with, the wellhead (not independently shown) that may be disposed above, and in fluid communication with, wellbore 106 that is being drilled. A central lumen may extend through the conventional MPD system (e.g., annular sealing system 110, annular closing system 115, and/or flow diverter 120), lower portion of marine riser system 125, BOP 130, wellhead (not independently shown), and into wellbore 106 to facilitate drilling and other operations. Drillstring 135 may be disposed through the central lumen and include, on a distal end, drill bit 140 used to drill wellbore 106.

In one or more embodiments of the present invention, an improved drilling system 300 may include a configuration capable of performing a method of hierarchical pressure management for MPD operations. In such embodiments, while MPD choke manifold 145 remains the primary pressure management device during normal operating conditions, an intelligent and programmable PCV system, including a PCV control system 600*b* and one or more PCV system valves 320, may be used to augment the ability of MPD choke manifold 145 to maintain wellbore pressure within the safe pressure gradient should one or more choke valves of the MPD choke manifold 145 plug, fail, or other contingency arises such that the MPD choke manifold 145 alone cannot maintain wellbore pressure. While the PCV control system assists in maintaining wellbore pressure, rig personnel may investigate the root cause of the pressure issues while protecting the structural integrity of the wellbore from adverse pressure events. In the event MPD choke manifold 145 and one or more PCV system valves 320 are unable to sufficiently manage wellbore pressure, PRV 175 may be triggered as the failsafe of last resort to protect rig equipment from high pressure by releasing all pressure in the system.

During MPD operations, one or more mud pumps 170 may controllably pump drilling fluids (not shown) from mud tank 165 downhole through an interior passageway of drillstring 135. The returning fluids (not shown) return through annulus 108 surrounding drillstring 135 and may be controllably diverted by flow diverter 120, or functional equivalent thereof, via flow line 122 to MPD choke manifold 145. MPD choke manifold 145 may controllably flow via flow line 147 to flow meter 150 and flow meter 150 may flow via flow line 153 to one or more fluids processing systems including, for example, MGS 155 and/or shale shakers 160 for processing prior to returning the processed fluids (not shown) to mud tanks 165 for reuse. One or more pressure sensors (not shown) may be disposed in the fluid path at different locations to measure pressure within the system 300. For example, discrete pressure sensors (not shown) as well as pressure sensors integrated (not independently illustrated) into one or more of MPD choke manifold 145, one or more PCV system valves 320, or PRV 175 may be used to provide measured pressure values at various points throughout the system.

As the first tier in hierarchical pressure management, MPD control system 600*a* may receive measured pressure values from one or more pressure sensors (not shown) and/or measured flow rates from flow meter 150 in approximate or near real-time. One of ordinary skill in the art will recognize that MPD choke manifold 145 may include a plurality of choke valves (not independently illustrated) that may be independently or jointly controlled by MPD control system 600*a*. MPD control system 600*a* may command one or more choke valves of MPD choke manifold 145 to a desired choke aperture setting or position and/or command the flow rate of mud pumps 170, thereby controlling wellbore pressure. The pressure tight seal on the annulus provided by annular sealing system 110 allows for control of wellbore pressure by manipulation of the choke aperture of one or more choke valves of MPD choke manifold 145 and the corresponding application of surface backpressure. While each choke valve may have an independently controllable choke aperture setting or position, one of ordinary skill in the art will recognize that reference to choke aperture setting or position may refer to the independent ability of one or more choke valves of MPD choke manifold 145, or the collective MPD choke manifold 145, to flow based on an application or design. The choke aperture or position of one or more choke valves, or the collective MPD choke manifold 145, may correspond to an amount, typically represented as a percentage, that one or more choke valves, or the collective MPD choke manifold 145, is open and capable of flowing.

For example, one or more choke valves of MPD choke manifold 145 may be fully opened where flow is unimpeded, fully closed where flow is stopped, or partially opened/closed where flow is restricted. If the choke operator wishes to increase wellbore pressure, the choke aperture setting of one or more choke valves, or the collective MPD choke manifold 145, may be reduced to further restrict fluid flow and apply additional surface backpressure. Similarly, if the choke operator wishes to decrease wellbore pressure, the choke aperture setting of one or more choke valves, or the collective MPD choke manifold 145, may be increased to increase fluid flow and reduce the amount of applied surface backpressure. As such, wellbore pressure may be managed by manipulating the choke aperture setting of one or more choke valves, or the collective MPD choke manifold 145, and/or the flow rate of mud pumps 170 that inject fluids downhole, based on, at least, pressure sensor data corresponding to measured pressure values.

As the second tier in hierarchical pressure management, an independent, intelligent, and programmable PCV control system 600*b* may control one or more PCV system valves 320 to augment and assist MPD choke manifold 145 in maintaining wellbore pressure under certain conditions. PCV control system 600*b* or one or more of PCV system valves 320 may include an integrated pressure sensor or gauge (not shown) and/or receive measured pressure values from one or more discrete (not shown) or integrated (not shown) pressure sensors in other equipment. In order to reduce the number of events in which PRV 175 opens, the PCV system may controllably open one or more PCV system valves 320 to provide an additional flow path for returning fluids in an effort to reduce the increasing pressure within the system, ideally preventing the system 300 from having to engage PRV 175 at all. A PCV set point for one or more of PCV system valves 320 may be defined as a pressure lower than the PRV set point, ensuring that one or more of PCV system valves 320 open before PRV 175 is triggered, and lower than the fracture pressure. When one or more PCV system valves 320 open, the PCV system seeks to maintain the pressure set point as constant as possible. The PCV system may include an aggressive trim and control that allow it to respond quickly and efficiently. In contrast to PRV 175, that has the primary objective of protecting rig equipment from high pressure events, the PCV system also protects the integrity of wellbore by preventing pressure inside the wellbore from exceeding the fracture pressure or falling below the pore pressure (or collapse pressure if the collapse pressure is higher than the pore pressure). Thus, if MPD choke manifold 145 is plugged, failed, or otherwise unable to manage wellbore pressure for whatever reason, the PCV system may open an additional flow path to assist in managing wellbore pressure without having to activate PRV 175, shut down on BOP 130, or take other drastic actions.

As the third tier in hierarchical pressure management, a PRV control system 600*c* may control PRV 175 and serve as a separate and independent failsafe to protect rig equipment from damage due to high and typically uncontrollably rising pressures within system 300. PRV control system 600*c* may receive measured pressure values from one or more pressure sensors (not shown), measured flow rates from flow meter 150 in approximate or near real-time, or other data in approximate or near real-time. PRV control system 600*c* may store a PRV set point that establishes the pressure at which PRV 175 is triggered and opens. Typically, the PRV set point is selected as a pressure value that protects the weakest link in the drilling system 100, often marine riser system 125 in offshore applications. Once opened, PRV 175 may discharge returning fluids from annulus 108 to the fluids processing system (e.g., MGS 155 or shale shakers 160) or overboard 180. While PRV 175 is protective of rig equipment and is designed to release as much pressure as possible as quickly as possible, it does not maintain nor manage wellbore pressure, which potentially damages the structural integrity of the wellbore and the ability of the rig to conduct further MPD operations. Thus, the invocation of PRV 175 as the failsafe of last resort results in the cessation of drilling operations and typically requires drastic actions such as shutting in on BOP 130 to secure the well, thereby substantially increasing costs required to restore well control and resume drilling operations, if it is even possible to do so.

With the multi-tiered hierarchical pressure management, if MPD choke manifold 145 cannot manage wellbore pressure during drilling operations and the wellbore pressure continues to rise, due to plugging, failure, or other contingencies that may arise, once the measured pressure crosses the threshold of the PCV set point, PCV control system 600*b* may command one or more PCV system valves 320 to open to the extent necessary to stabilize wellbore pressure, diverting returning fluids from annulus 108 to MGS 155, shale shaker 160, or other fluids processing systems. In doing so, wellbore pressure may be maintained within the safe pressure gradient, below the fracture pressure of the formation, and above the pore pressure of the formation without having to activate PRV 175, shut down on BOP 130, or take other drastic actions. Advantageously, the rig crew is provided an opportunity to investigate the root cause of the pressure issue, while maintaining wellbore pressure, and without risk to the structural integrity of the wellbore or the safety of personnel.

Figure 4:
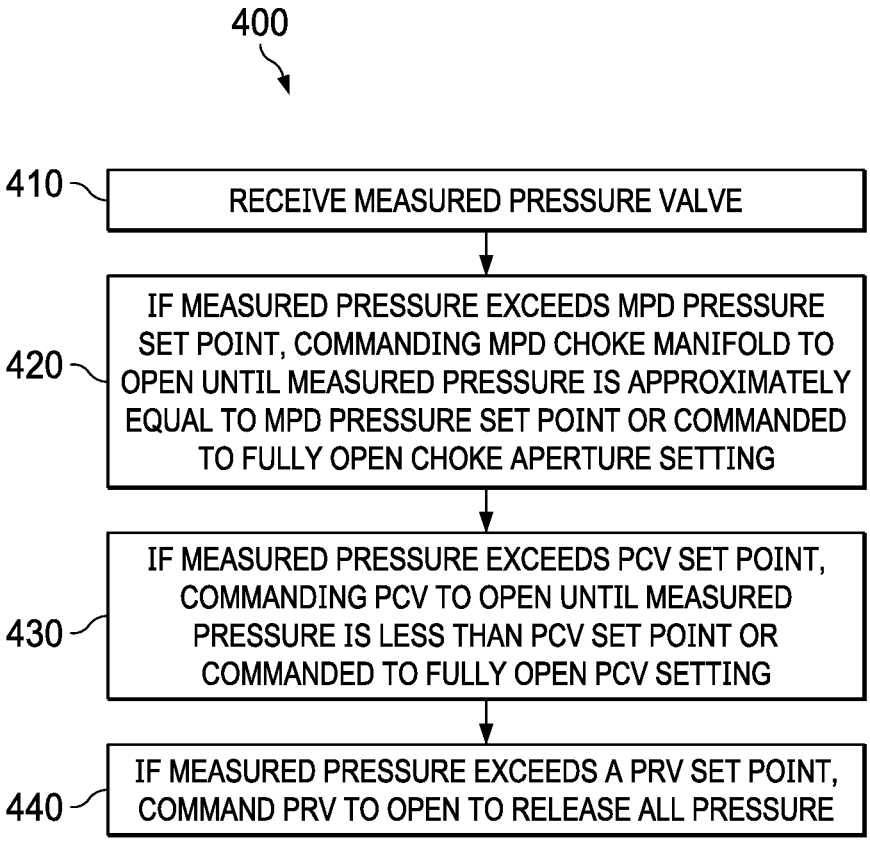
FIG. 4 shows a method of hierarchical pressure management for managed pressure drilling operations in accordance with one or more embodiments of the present invention.

FIG. 4 shows a method 400 of hierarchical pressure management for managed pressure drilling operations in accordance with one or more embodiments of the present invention. One of ordinary skill in the art will recognize that software including, for example, one or more hydraulic models and/or simulations, may provide models, predicted safe pressure gradients, predicted distributions of wellbore pressure as a function of depth, as well as anticipated MPD pressure set points, PCV set point, and PRV set point prior to undertaking the actual drilling operations. The software may take into consideration the type and kind of equipment used as part of the drilling rig, the type and kind of well to be drilled, and information relating to what is known about the earth through which the wellbore is to be drilled and the drilling environment. These activities are typically undertaken prior to commencement of drilling operations. Once complete, further use of hydraulic models, simulations, and stress testing may be performed to refine the models, predicted gradients, predicted distributions of pressure, and set points, prior to undertaking actual drilling operations.

Once drilling operations commence, the hydraulic model may receive near real-time information from various equipment and sensors of the drilling rig and, while the drilling operation is underway, the software may update its models, predicted pressure gradients, predicted distributions of pressure, and set points continuously, periodically, or as more information becomes available. The hydraulic model typically will provide an MPD pressure set point corresponding to a desired surface backpressure, standpipe pressure, or model-based downhole pressure within the safe pressure gradient, however, the MPD pressure set point may be provided by a user. The MPD control system may command one or more choke valves of the MPD choke manifold to adjust the choke aperture setting of the one or more choke valves a calibrated amount to achieve the MPD pressure set point. When the measured pressure is maintained at a value that is approximately equal to the MPD pressure set point, drilling operations may commence or resume as the case may be.

At step 410, one or more measured pressure values may be received by, at least, an MPD control system, a PCV control system, and a PRV control system. Each measured pressure value represents an actual measurement of pressure made by an integrated or discrete pressure sensor as part of the drilling system. Typically, with respect to the measurement of surface backpressure, the measured pressure value corresponds to a measurement of surface backpressure taken at the surface, typically by a pressure sensor integrated, or disposed in line, with the MPD choke manifold. The pressure may be measured continuously, periodically, or upon the occurrence of a predetermined event. The measured pressure values may be transmitted to the MPD control system, PCV control system, PRV control system or a hydraulic model that may execute on, or independently of, one of the control systems. The hydraulic model may use one or more of model data, simulation data, and measured pressure value data to calculate an MPD pressure set point on an ongoing basis to achieve a desired wellbore pressure for the current operating conditions. The hydraulic model may provide an MPD pressure set point to the MPD control system. In response, the MPD control system may command one or more choke valves of the MPD choke manifold to a calibrated choke aperture setting that achieves the MPD pressure set point. However, contingencies may arise that prevent the MPD choke manifold from managing pressure at the MPD pressure set point, including, for example, plugging, failure, or other contingencies that affect one or more of the choke valves. While one or more choke valves of the MPD choke manifold may have a self-clearing function that attempts to dislodge any debris that may be restricting flow, such operations are not always successful. The MPD control system, or choke operator, may have the ability to open additional choke valves or selectively choose those choke valves that are not plugged and remain operational, however, it may limit the ability of the MPD choke manifold to manage wellbore pressure. Against this backdrop, the method described herein relates to hierarchical pressure management for MPD operations.

At step 420, if the measured pressure exceeds the MPD pressure set point, the MPD control system may command one or more choke valves of the MPD choke manifold to open to the extent necessary until the measured pressure value is approximately equal to the MPD pressure set point or the one or more choke valves of the MPD choke manifold are commanded to the fully opened choke aperture setting corresponding to the maximum ability to flow. The hydraulic model may determine, in view of the difference between the measured pressure value and the MPD pressure set point, adjustments to the choke aperture setting, or position, of the one or more choke valves of the MPD choke manifold that may be necessary to achieve the MPD pressure set point. However, one or more choke valves of the MPD choke manifold may experience plugging, failure, or other contingencies. If the MPD control system commands one or more choke valves of the MPD choke manifold to their fully opened choke aperture setting, or position, corresponding to the maximum ability to flow, and the measured pressure still exceeds the MPD pressure set point, a contingency arises where the MPD choke manifold alone is no longer capable of managing wellbore pressure safely within the safe pressure gradient. In conventional drilling systems, such an occurrence would require the cessation of drilling, activation of the PRV, shutting down on the BOP, and other drastic actions that jeopardize the structural integrity of the wellbore and the ability to eventually resume drilling operations.

Advantageously, at step 430, if at any time the measured pressure exceeds a PCV set point, the MPD control system may park the MPD choke manifold such that it maintains its last position, often commanded to the fully opened up state, and a PCV control system may command one or more PCV system valves to open until the measured pressure is less than the PCV set point or the one or more PCV system valves are commanded to a fully opened PCV setting. The one or more PCV system valves may flow to the MGS, shale shakers, other fluids processing system, or discharge overboard in offshore applications. In certain embodiments, the PCV set point may be determined by the hydraulic model as a value that is lower than the PRV set point by a predetermined safety margin sufficient to prevent the PRV from opening unless the MPD choke manifold and the PCV system cannot manage wellbore pressure. In other embodiments, the PCV set point may be automatically determined by the hydraulic model as a value that is lower than a PRV set point by a sufficient margin to allow one or more PCV system valves to fully open before the measured pressure exceeds the PRV set point, based on, in part, information about the type or kinds of choke valves and their ability to discharge flow. In still other embodiments, the PCV set point may be automatically determined by the hydraulic model based on a fracture pressure curve.

Advantageously, the PCV system may open an additional fluid path to prevent pressures from rising further, while at the same time, also preventing pressure inside the wellbore from falling. Once opened, the PCV system may attempt to keep the PCV set point as constant as possible with an aggressive trim and control that allows for fast response. If the pressure stabilizes at the PCV set point, the rig crew may be able to investigate the root cause and attempt to resolve the issue. If the problem is resolved, drilling operations may be resumed when once measured pressure is capable of being maintained at a value approximately equal to the MPD pressure set point.

At step 440, if at any time the measured pressure exceeds a PRV set point, a PRV control system may command the PRV to open as a failsafe of last resort. The PRV set point may be determined by determining a lowest pressure value from a set of maximum operating pressures for equipment of the drilling system. The PRV set point may be set to the lowest pressure value determined less an optional predetermined safety margin. The PRV set point may be determined by one or more of the hydraulic models, simulation, or user input. While the PRV protects rig equipment from high pressure events, once opened, wellbore pressure will fall until all pressure within the system is released, meaning that wellbore pressure is not managed within the safe pressure gradient, may fall below the pore pressure, and drastic actions such as, for example, shutting down on the BOP to secure the well, may be required. As such, invocation of the PRV is viewed as a worst-case action taken only as a measure of last resort when the MPD choke manifold and PCV cannot manage wellbore pressure. The PRV may flow to the MGS, shale shakers, or discharge overboard in offshore applications. In one or more embodiments of the present invention, a non-transitory computer readable medium comprising software instructions that, when executed by a processor, may perform any of the above-noted methods.

Figure 5A:
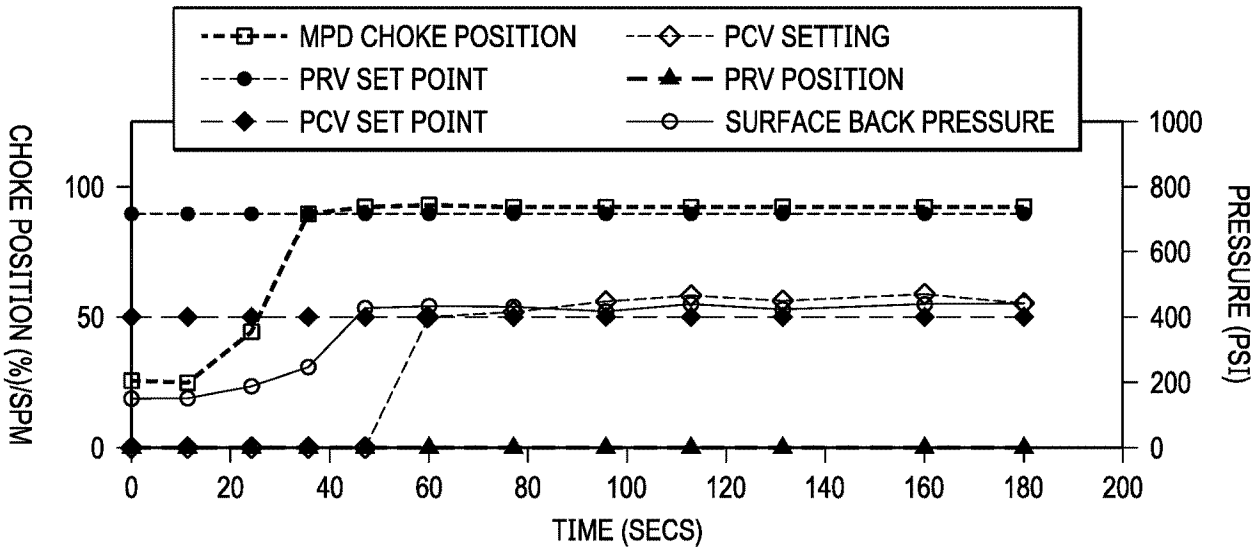
FIG. 5A shows an exemplary plot of MPD choke position, surface backpressure, pressure control valve set point, pressure control valve setting, pressure relief valve set point, and pressure relief valve position where the pressure control valve system is used to augment the MPD choke manifold in managing wellbore pressure within the safe pressure gradient in a system for hierarchical pressure management for managed pressure drilling operations in accordance with one or more embodiments of the present invention.
Figure 5B:
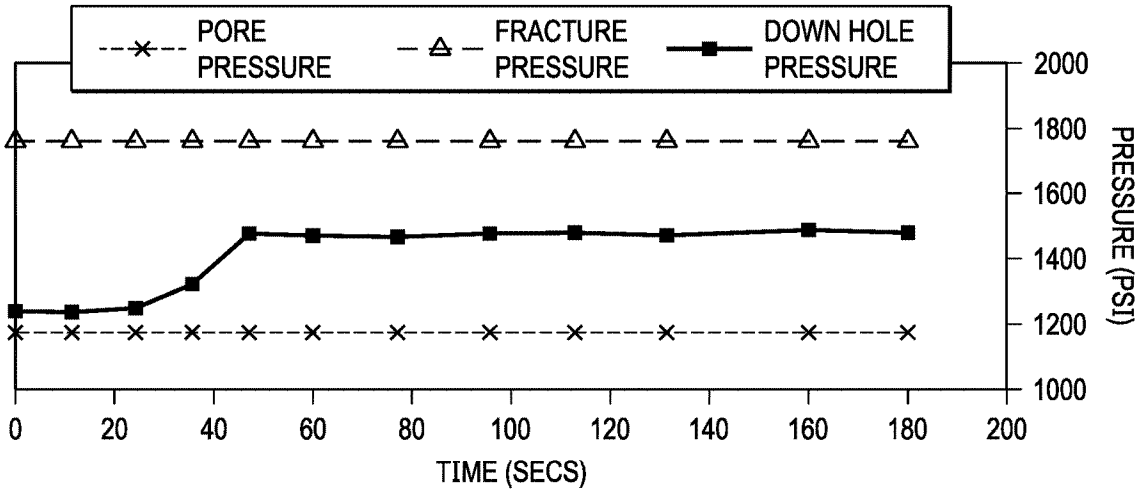
FIG. 5B shows an exemplary plot of pore pressure, fracture pressure, and downhole pressure where the pressure control valve system is used to augment the MPD choke manifold in managing wellbore pressure within the safe pressure gradient in a system for hierarchical pressure management for managed pressure drilling operations in accordance with one or more embodiments of the present invention.

FIG. 5A shows an exemplary plot of MPD choke position, surface backpressure, PCV set point, PCV setting, PRV set point, and PRV position where the PCV system is used to augment the MPD choke manifold (e.g., 145 of FIG. 3) in managing wellbore pressure within the safe pressure gradient in a system (e.g., 300 of FIG. 3) for hierarchical pressure management for managed pressure drilling operations in accordance with one or more embodiments of the present invention. FIG. 5A and FIG. 5B show an example of how the method and system for hierarchical pressure management for MPD operations would handle the exemplary situation shown in FIG. 2A and FIG. 2B. Initially, the MPD choke position, and corresponding surface backpressure, are relatively constant as would be expected during normal drilling operations. In the event one or more choke valves of the MPD choke manifold (e.g., 145 of FIG. 3) starts to plug, fail, or other contingency arises, the surface backpressure may start to rise for reasons unrelated to a deliberate closing of one or more choke valves of the MPD choke manifold (e.g., 145 of FIG. 3). The MPD control system (e.g., 600*a* of FIG. 3) may, in response to rising surface backpressure, command one or more choke valves of the MPD choke manifold (e.g., 145 of FIG. 3) to open in an attempt to stabilize pressure. However, even after one or more choke valves of the MPD choke manifold (e.g., 145 of FIG. 3) are commanded to a fully opened choke aperture setting, corresponding to maximum ability to flow, surface backpressure continues to rise. Once surface backpressure exceeds the PCV set point, a PCV control system (e.g., 600*b* of FIG. 3) may command one or more PCV system valves (e.g., 320 of FIG. 3) to open to assist the MPD choke manifold (e.g., 145 of FIG. 3) in managing wellbore pressure. In the example depicted, the PCV (e.g., 320 of FIG. 3) stops the pressure from rising further and the pressure stabilize at or near the PCV set point. At this time, rig personnel may investigate the root cause of the pressure issue while the one or more PCV system valves (e.g., 320 of FIG. 3) protect the structural integrity of the wellbore.

Continuing, FIG. 5B shows an exemplary plot of pore pressure, fracture pressure, and downhole pressure where one or more PCV system valves (e.g., 320 of FIG. 3) are used to augment the MPD choke manifold (e.g., 145 of FIG. 3) in managing wellbore pressure within the safe pressure gradient in a system (e.g., 300 of FIG. 3) for hierarchical pressure management for managed pressure drilling operations in accordance with one or more embodiments of the present invention. A safe pressure gradient may be established by the pore pressure (or collapse pressure in certain cases) and the fracture pressure as shown. Initially, the downhole pressure closely tracks, but is slightly higher than, the pore pressure, but well within the safe pressure gradient. As one or more choke valves of the MPD choke manifold (e.g., 145 of FIG. 3) start to plug, fail, or other contingency arises, the downhole pressure starts to rise. As shown in FIG. 5A, the MPD control system (e.g., 600*a* of FIG. 3) attempted to manage the downhole pressure within the safe pressure gradient by opening up one or more choke valves of the MPD choke manifold (e.g., 145 of FIG. 3). However, the MPD choke manifold (e.g., 145 of FIG. 3) alone was unable to maintain downhole pressure within the safe pressure gradient. Instead of activating the PRV (e.g., 175 of FIG. 3), the PCV control system (e.g., 600*b* of FIG. 3) commands one or more PCV system valves (e.g., 320 of FIG. 3) to open in an attempt to assist the MPD choke manifold (e.g., 145 of FIG. 3) to manage wellbore pressure within the safe pressure gradient. Once one or more PCV system valves (e.g., 320 of FIG. 3) open, surface backpressure (see FIG. 5A) stabilizes at or near the PCV set point and downhole pressure stabilizes at a pressure value safely within the safe pressure gradient. Advantageously, unlike the situation depicted in FIG. 2A and FIG. 2B, the downhole pressure never exceeds the fracture pressure, never falls below the pore pressure, and the structural integrity of the wellbore is maintained, and without having to activate the PRV (e.g., 175 of FIG. 3). Advantageously, the rig personnel may investigate the root cause of the pressure issue while one or more PCV system valves (e.g., 320 of FIG. 3) protect the structural integrity of the wellbore. Once cleared, flow may be resumed to the MPD choke manifold (e.g., 145 of FIG. 3). So long as pressure is managed within the safe pressure gradient, drilling operations may resume.

Figure 6:
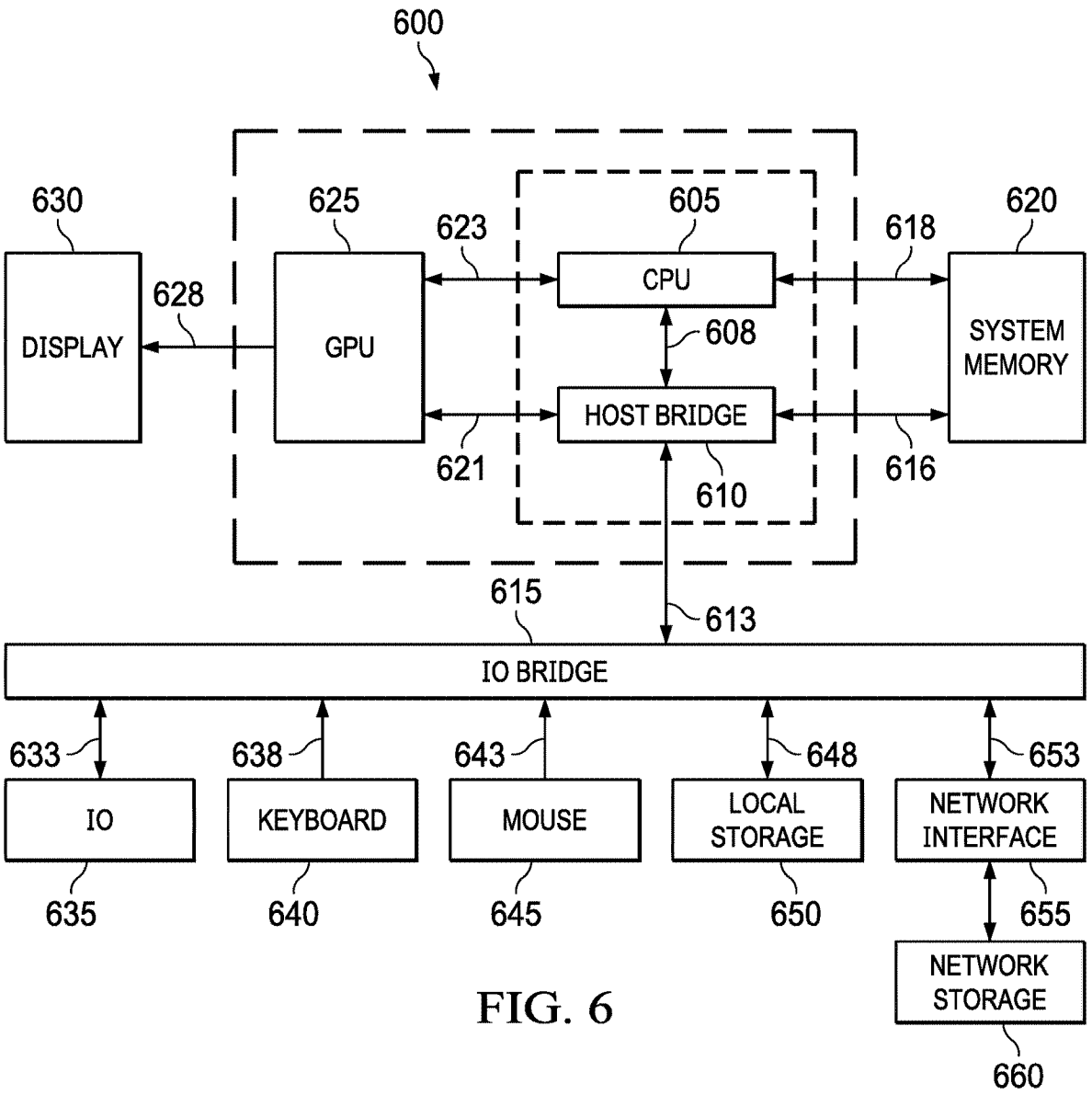
FIG. 6 shows an exemplary computer or control system in accordance with one or more embodiments of the present invention.

FIG. 6 shows a computer or control system 600 in accordance with one or more embodiments of the present invention. One of ordinary skill in the art will recognize that, as discussed above, a system for hierarchical pressure management for managed pressure drilling operations (e.g., 300 of FIG. 3) may include a plurality of control systems (e.g., MPD control system 600*a*, PCV control system 600*b*, or PRV control system 600*c*) that function independent of one another to the extent that the failure of one aspect of hierarchical pressure management does not cause the failure of another aspect of hierarchical pressure management as a safeguard for the protection of the drilling system, on-rig personnel, and the environment. Notwithstanding the above, in certain embodiments, such control systems, or the functions or features they implement, may be integrated or distributed based on an application or design in accordance with one or more embodiments of the present invention. One of ordinary skill in the art will also recognize that MPD control system 600*a*, PCV control system 600*b*, and PRV control system 600*c* may vary from one another, and from application to application, based on an application or design in accordance with one or more embodiments of the present invention.

An exemplary computer or control system 600 may include one or more of a Central Processing Unit ("CPU") 605, a host bridge 610, an Input/Output ("IO") bridge 615, a Graphics Processing Unit ("GPUs") 625, an Application-Specific Integrated Circuit ("ASIC") (not shown), and a Programmable Logic Controller ("PLC") (not shown) disposed on one or more printed circuit boards (not shown) that perform computational or logical operations. Each CPU 605, GPU 625, ASIC (not shown), and PLC (not shown) may be a single-core device or a multi-core device. Multi-core devices typically include a plurality of cores (not shown) disposed on the same physical die (not shown) or a plurality of cores (not shown) disposed on multiple die (not shown) that are collectively disposed within the same mechanical package (not shown).

CPU 605 may be a general-purpose computational device that typically executes software instructions. CPU 605 may include one or more of an interface 608 to host bridge 610, an interface 618 to system memory 620, and an interface 623 to one or more IO devices, such as, for example, one or more GPUs 625. GPU 625 may serve as a specialized computational device that typically performs graphics functions related to frame buffer manipulation. However, one of ordinary skill in the art will recognize that GPU 625 may be used to perform non-graphics related functions that are computationally intensive. In certain embodiments, GPU 625 may interface 623 directly with CPU 605 (and indirectly interface 618 with system memory 620 through CPU 605). In other embodiments, GPU 625 may interface 621 directly with host bridge 610 (and indirectly interface 616 or 618 with system memory 620 through host bridge 610 or CPU 605 depending on the application or design). In still other embodiments, GPU 625 may directly interface 633 with IO bridge 615 (and indirectly interface 616 or 618 with system memory 620 through host bridge 610 or CPU 605 depending on the application or design). One of ordinary skill in the art will recognize that GPU 625 includes on-board memory as well. The functionality of GPU 625 may be integrated, in whole or in part, with CPU 605 and/or host bridge 610.

Host bridge 610 may be an interface device that interfaces between the one or more computational devices and IO bridge 615 and, in some embodiments, system memory 620. Host bridge 610 may include an interface 608 to CPU 605, an interface 613 to IO bridge 615, for embodiments where CPU 605 does not include an interface 618 to system memory 620, an interface 616 to system memory 620, and for embodiments where CPU 605 does not include an integrated GPU 625 or an interface 623 to GPU 625, an interface 621 to GPU 625. The functionality of host bridge 610 may be integrated, in whole or in part, with CPU 605 and/or GPU 625.

IO bridge 615 may be an interface device that interfaces between the one or more computational devices and various IO devices (e.g., 640, 645) and IO expansion, or add-on, devices (not independently illustrated). IO bridge 615 may include an interface 613 to host bridge 610, one or more interfaces 633 to one or more IO expansion devices 635, an interface 638 to keyboard 640, an interface 643 to mouse 645, an interface 648 to one or more local storage devices 650, and an interface 653 to one or more network interface devices 655. The functionality of IO bridge 615 may be integrated, in whole or in part, with CPU 605 and/or host bridge 610. Each local storage device 650, if any, may be a solid-state memory device, a solid-state memory device array, a hard disk drive, a hard disk drive array, or any other non-transitory computer readable medium. Network interface device 655 may provide one or more network interfaces including any network protocol suitable to facilitate networked communications.

Control system 600 may include one or more network-attached storage devices 660 in addition to, or instead of, one or more local storage devices 650. Each network-attached storage device 660, if any, may be a solid-state memory device, a solid-state memory device array, a hard disk drive, a hard disk drive array, or any other non-transitory computer readable medium. Network-attached storage device 660 may or may not be collocated with control system 600 and may be accessible to control system 600 via one or more network interfaces provided by one or more network interface devices 655.

One of ordinary skill in the art will recognize that control system 600 may be a conventional computing system or an application-specific computing system (not shown). In certain embodiments, an application-specific computing system (not shown) may include one or more ASICs (not shown) or programmable logic controllers ("PLCs") (not shown) that perform one or more specialized functions in a more efficient manner. The one or more ASICs (not shown) may interface directly with CPU 605, host bridge 610, or GPU 625 or interface through IO bridge 615. Alternatively, in other embodiments, an application-specific computing system (not shown) may be reduced to only those components necessary to perform a desired function or functions in an effort to reduce one or more of chip count, printed circuit board footprint, thermal design power, and power consumption. The one or more ASICs (not shown) or PLCs (not shown) may be used instead of one or more of CPU 605, host bridge 610, IO bridge 615, or GPU 625. In such systems, the one or more ASICs (not shown) or PLCs (not shown) may incorporate sufficient functionality to perform certain network, computational, or logical functions in a minimal footprint with substantially fewer component devices.

As such, one of ordinary skill in the art will recognize that CPU 605, host bridge 610, IO bridge 615, GPU 625, ASIC (not shown), or PLC (not shown) or a subset, superset, or combination of functions or features thereof, may be integrated, distributed, or excluded, in whole or in part, based on an application, design, or form factor in accordance with one or more embodiments of the present invention. Thus, the description of control system 600 is merely exemplary and not intended to limit the type, kind, or configuration of component devices that constitute a control system 600 suitable for performing computing operations in accordance with one or more embodiments of the present invention. Notwithstanding the above, one of ordinary skill in the art will recognize that control system 600 may be an industrial, standalone, laptop, desktop, server, blade, or rack mountable system and may vary based on an application or design.

Advantages of one or more embodiments of the present invention may include one or more of the following:

In one or more embodiments of the present invention, hierarchical pressure management for MPD operations provides a multi-tiered hierarchical pressure control regime that augments the ability of the MPD choke manifold to manage wellbore pressure within the safe pressure gradient in a manner that protects the structural integrity of the wellbore when pressure contingencies arise.

In one or more embodiments of the present invention, hierarchical pressure management for MPD operations manages wellbore pressure within the safe pressure gradient even when serious pressure contingencies arise, giving on-rig personnel the critical time necessary to resolve the issue without compromising the structural integrity of the wellbore.

In one or more embodiments of the present invention, hierarchical pressure management for MPD operations manages wellbore pressure within the safe pressure gradient even when serious pressure contingencies arise, without having to activate the PRV, shut down on the BOP, or take other drastic actions.

In one or more embodiments of the present invention, hierarchical pressure management for MPD operations increases the operational up time and efficiency of the drilling system by enabling go ahead operations even when serious pressure contingencies arise.

In one or more embodiments of the present invention, hierarchical pressure management for MPD operations improves the safety of operations.

In one or more embodiments of the present invention, hierarchical pressure management for MPD operations protects the environment from fouling normally associated with discharging returning fluids overboard when the PRV is activated.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of hierarchical pressure management for managed pressure drilling operations comprising:

receiving a measured pressure value;

if the measured pressure exceeds an MPD pressure set point, commanding one or more choke valves of an MPD choke manifold to open until the measured pressure is approximately equal to the MPD pressure set point or is commanded to a fully opened choke aperture setting;

automatically determining, with a hydraulic model, a pressure control valve set point based on a fracture pressure curve;

if at any time the measured pressure exceeds the pressure control valve set point, parking the MPD choke manifold and commanding one or more pressure control valve system valves to open until the measured pressure is less than the pressure control valve set point or is commanded to a fully opened pressure control valve setting; and if at any time the measured pressure exceeds a pressure relief valve set point, commanding a pressure relief valve to open.

2. The method of claim 1, further comprising:

receiving the MPD pressure set point from a hydraulic model.

3. The method of claim 1, further comprising:

commanding the MPD choke manifold to the MPD pressure set point.

4. The method of claim 1, further comprising:

determining a lowest pressure value from a set of maximum operating pressures for equipment of a drilling system; and setting the pressure relief valve set point to the lowest pressure value less a predetermined safety margin.

5. The method of claim 1, further comprising:

determining the pressure control valve set point that is lower than the pressure relief valve set point by a predetermined safety margin sufficient to prevent the pressure relief valve from opening.

6. The method of claim 1, further comprising:

automatically determining, with a hydraulic model, the pressure control valve set point that is lower than the pressure relief valve set point by a sufficient margin to allow the pressure control valve to fully open before the measured pressure exceeds the pressure relief valve set point.

7. The method of claim 1, further comprising:

commencing drilling operations when the measured pressure is maintained at a value approximately equal to the MPD pressure set point.

8. The method of claim 1, further comprising:

after one or more pressure control valve system valves have been opened and the measured pressure is reduced to a value lower than the pressure control valve set point, resuming drilling operations when the measured pressure is maintained at a value approximately equal to the MPD pressure set point.

9. The method of claim 1, further comprising:

if the measured pressure falls below the MPD pressure set point, commanding the MPD choke manifold to close until the measured pressure is approximately equal to the MPD pressure set point or is commanded to a fully closed MPD choke manifold setting.

10. The method of claim 1, wherein the measured pressure value is received from a pressure sensor.

11. The method of claim 1, wherein the one or more pressure control valve system valves flow to a mud-gas-separator.

12. The method of claim 1, wherein the pressure relief valve discharges flow overboard.

13. The method of claim 1, wherein the pressure relief valve flows to a mud-gas-separator.

14. The method of claim 1, wherein the pressure relief valve flows to a shale shaker.

15. The method of claim 1, wherein if the measured pressure falls outside predetermined MPD pressure limits, stopping drilling operations and maintaining a fluid injection rate.

16. The method of claim 1, wherein if the measured pressure falls outside predetermined pressure control valve pressure limits, securing a well on the blow-out preventer.

17. A system for hierarchical pressure management for managed pressure drilling operations comprising:

an annular sealing system that provides an annular seal surrounding a drillstring;

a pressure sensor that measures pressure;

an MPD choke manifold comprising a plurality of choke valves with at least one choke valve in fluid communication with a flow line that diverts returning fluids from or below the annular seal to apply surface back-pressure;

an MPD control system that commands one or more choke valves of the MPD choke manifold to an MPD pressure set point;

one or more pressure control valves with at least one pressure control valve in fluid communication with the flow line that discharges returning fluids to a mud-gas-separator, shale shaker, or other fluids processing system;

a pressure control valve control system that commands one or more pressure control valves to open when the measured pressure exceeds a pressure control valve set point;

a pressure relief valves that discharges returning fluids to the mud-gas separator, shale shaker, or overboard; and a pressure relief valve control system that commands the pressure relief valve to open when the measured pressure exceeds a pressure relief valve set point, wherein the MPD control system, pressure control valve control system, and pressure relief valve control system are independent.

18. A method of hierarchical pressure management for managed pressure drilling operations comprising:

receiving a measured pressure value;

if the measured pressure exceeds an MPD pressure set point, commanding one or more choke valves of an MPD choke manifold to open until the measured pressure is approximately equal to the MPD pressure set point or is commanded to a fully opened choke aperture setting;

automatically determining, with a hydraulic model, a pressure control valve set point that is lower than a pressure relief valve set point by a sufficient margin to allow the pressure control valve to fully open before the measured pressure exceeds the pressure relief valve set point;

if at any time the measured pressure exceeds the pressure control valve set point, parking the MPD choke manifold and commanding one or more pressure control valve system valves to open until the measured pressure is less than the pressure control valve set point or is commanded to a fully opened pressure control valve setting; and if at any time the measured pressure exceeds the pressure relief valve set point, commanding a pressure relief valve to open.

19. The method of claim 18, further comprising:

receiving the MPD pressure set point from a hydraulic model.

20. The method of claim 18, further comprising:

commanding the MPD choke manifold to the MPD pressure set point.

21. The method of claim 18, further comprising:

determining a lowest pressure value from a set of maximum operating pressures for equipment of a drilling system; and setting the pressure relief valve set point to the lowest pressure value less a predetermined safety margin.

22. The method of claim 18, further comprising:

determining the pressure control valve set point that is lower than the pressure relief valve set point by a predetermined safety margin sufficient to prevent the pressure relief valve from opening.

23. The method of claim 18, further comprising:

automatically determining, with a hydraulic model, the pressure control valve set point based on a fracture pressure curve.

24. The method of claim 18, further comprising:

commencing drilling operations when the measured pressure is maintained at a value approximately equal to the MPD pressure set point.

25. The method of claim 18, further comprising:

after one or more pressure control valve system valves have been opened and the measured pressure is reduced to a value lower than the pressure control valve set point, resuming drilling operations when the measured pressure is maintained at a value approximately equal to the MPD pressure set point.

26. The method of claim 18, further comprising:

if the measured pressure falls below the MPD pressure set point, commanding the MPD choke manifold to close until the measured pressure is approximately equal to the MPD pressure set point or is commanded to a fully closed MPD choke manifold setting.

27. The method of claim 18, wherein the measured pressure value is received from a pressure sensor.

28. The method of claim 18, wherein the one or more pressure control valve system valves flow to a mud-gas-separator.

29. The method of claim 18, wherein the pressure relief valve discharges flow overboard.

30. The method of claim 18, wherein the pressure relief valve flows to a mud-gas-separator.

31. The method of claim 18, wherein the pressure relief valve flows to a shale shaker.

32. The method of claim 18, wherein if the measured pressure falls outside predetermined MPD pressure limits, stopping drilling operations and maintaining a fluid injection rate.

33. The method of claim 18, wherein if the measured pressure falls outside predetermined pressure control valve pressure limits, securing a well on the blow-out preventer.

34. A method of hierarchical pressure management for managed pressure drilling operations comprising:

receiving a measured pressure value;

if the measured pressure exceeds an MPD pressure set point, commanding one or more choke valves of an MPD choke manifold to open until the measured pressure is approximately equal to the MPD pressure set point or is commanded to a fully opened choke aperture setting;

determining a pressure control valve set point that is lower than a pressure relief valve set point by a predetermined safety margin sufficient to prevent the pressure relief valve from opening;

if at any time the measured pressure exceeds the pressure control valve set point, parking the MPD choke manifold and commanding one or more pressure control valve system valves to open until the measured pressure is less than the pressure control valve set point or is commanded to a fully opened pressure control valve setting; and if at any time the measured pressure exceeds the pressure relief valve set point, commanding a pressure relief valve to open.

35. The method of claim 34, further comprising:

receiving the MPD pressure set point from a hydraulic model.

36. The method of claim 34, further comprising:

commanding the MPD choke manifold to the MPD pressure set point.

37. The method of claim 34, further comprising:

determining a lowest pressure value from a set of maximum operating pressures for equipment of a drilling system; and setting the pressure relief valve set point to the lowest pressure value less a predetermined safety margin.

38. The method of claim 34, further comprising:

automatically determining, with a hydraulic model, the pressure control valve set point based on a fracture pressure curve.

39. The method of claim 34, further comprising:

automatically determining, with a hydraulic model, the pressure control valve set point that is lower than the pressure relief valve set point by a sufficient margin to allow the pressure control valve to fully open before the measured pressure exceeds the pressure relief valve set point.

40. The method of claim 34, further comprising:

commencing drilling operations when the measured pressure is maintained at a value approximately equal to the MPD pressure set point.

41. The method of claim 34, further comprising:

after one or more pressure control valve system valves have been opened and the measured pressure is reduced to a value lower than the pressure control valve set point, resuming drilling operations when the measured pressure is maintained at a value approximately equal to the MPD pressure set point.

42. The method of claim 34, further comprising:

if the measured pressure falls below the MPD pressure set point, commanding the MPD choke manifold to close until the measured pressure is approximately equal to the MPD pressure set point or is commanded to a fully closed MPD choke manifold setting.

43. The method of claim 34, wherein the measured pressure value is received from a pressure sensor.

44. The method of claim 34, wherein the one or more pressure control valve system valves flow to a mud-gas-separator.

45. The method of claim 34, wherein the pressure relief valve discharges flow overboard.

46. The method of claim 34, wherein the pressure relief valve flows to a mud-gas-separator.

47. The method of claim 34, wherein the pressure relief valve flows to a shale shaker.

48. The method of claim 34, wherein if the measured pressure falls outside predetermined MPD pressure limits, stopping drilling operations and maintaining a fluid injection rate.

49. The method of claim 34, wherein if the measured pressure falls outside predetermined pressure control valve pressure limits, securing a well on the blow-out preventer.

50. A method of hierarchical pressure management for managed pressure drilling operations comprising:

determining a lowest pressure value from a set of maximum operating pressures for equipment of a drilling system;

setting a pressure relief valve set point to the lowest pressure value less a predetermined safety margin;

receiving a measured pressure value;

if the measured pressure exceeds an MPD pressure set point, commanding one or more choke valves of an MPD choke manifold to open until the measured pressure is approximately equal to the MPD pressure set point or is commanded to a fully opened choke aperture setting;

if at any time the measured pressure exceeds a pressure control valve set point, parking the MPD choke manifold and commanding one or more pressure control valve system valves to open until the measured pressure is less than the pressure control valve set point or is commanded to a fully opened pressure control valve setting; and if at any time the measured pressure exceeds the pressure relief valve set point, commanding a pressure relief valve to open.

51. The method of claim 50, further comprising:

receiving the MPD pressure set point from a hydraulic model.

52. The method of claim 50, further comprising:

commanding the MPD choke manifold to the MPD pressure set point.

53. The method of claim 50, further comprising:

determining the pressure control valve set point that is lower than the pressure relief valve set point by a predetermined safety margin sufficient to prevent the pressure relief valve from opening.

54. The method of claim 50, further comprising:

automatically determining, with a hydraulic model, the pressure control valve set point based on a fracture pressure curve.

55. The method of claim 50, further comprising:

automatically determining, with a hydraulic model, the pressure control valve set point that is lower than the pressure relief valve set point by a sufficient margin to allow the pressure control valve to fully open before the measured pressure exceeds the pressure relief valve set point.

56. The method of claim 50, further comprising:

commencing drilling operations when the measured pressure is maintained at a value approximately equal to the MPD pressure set point.

57. The method of claim 50, further comprising:

after one or more pressure control valve system valves have been opened and the measured pressure is reduced to a value lower than the pressure control valve set point, resuming drilling operations when the measured pressure is maintained at a value approximately equal to the MPD pressure set point.

58. The method of claim 50, further comprising:

if the measured pressure falls below the MPD pressure set point, commanding the MPD choke manifold to close until the measured pressure is approximately equal to the MPD pressure set point or is commanded to a fully closed MPD choke manifold setting.

59. The method of claim 50, wherein the measured pressure value is received from a pressure sensor.

60. The method of claim 50, wherein the one or more pressure control valve system valves flow to a mud-gas-separator.

61. The method of claim 50, wherein the pressure relief valve discharges flow overboard.

62. The method of claim 50, wherein the pressure relief valve flows to a mud-gas-separator.

63. The method of claim 50, wherein the pressure relief valve flows to a shale shaker.

64. The method of claim 50, wherein if the measured pressure falls outside predetermined MPD pressure limits, stopping drilling operations and maintaining a fluid injection rate.

65. The method of claim 50, wherein if the measured pressure falls outside predetermined pressure control valve pressure limits, securing a well on the blow-out preventer.

* * * * *